US005778616A

United States Patent [19]

Howes

[11] Patent Number: 5,778,616

[45] Date of Patent: Jul. 14, 1998

[54] SCRUBBER MOUNTING APPARATUS

[75] Inventor: Brian C. Howes, Calgary, Canada

[73] Assignee: Beta Machinery Analysis Ltd., Calgary, Canada

[21] Appl. No.: 611,288

[22] Filed: Mar. 6, 1996

Related U.S. Application Data

[63] Continuation of Ser. No. 253,361, Jun. 3, 1994, abandoned, which is a continuation-in-part of Ser. No. 4,792, Jan. 14, 1993, abandoned.

[51] Int. Cl.[6] ..... B23P 19/04; E02D 27/38; E04H 7/02

[52] U.S. Cl. ..... 52/247; 52/292; 29/773; 29/801; 29/897.35

[58] Field of Search ..... 29/281.1, 462, 29/509, 773, 776, 801, 890.14, 897.35; 52/192, 247, 292, 667

[56] References Cited

U.S. PATENT DOCUMENTS

| | | | |
|---|---|---|---|
| 883,164 | 3/1908 | Benson | 52/247 |
| 3,927,497 | 12/1975 | Yoshinaga et al. | 52/247 X |
| 4,503,645 | 3/1985 | Nudd et al. | 52/292 X |
| 4,555,886 | 12/1985 | Wiechowski | 52/667 |
| 4,602,463 | 7/1986 | Holowatyi | 52/247 X |
| 4,928,401 | 5/1990 | Murray, Jr. . | |

OTHER PUBLICATIONS

"Vibration Reduction Techniques for High-Speed Rotating Equipment"; *American Society of Mechanical Engineers* Baumann, Nelson P. et al; Chicago, Illinois; Aug. 5, 1965.

"Vernier-Strobe System of Machinery Shaft/Coupling Alignment Thermal Growth Measurement" and Various Attached Documentation published by Murray & Garig Tool Works; Murray, Malcolm Baytown, Texas; Aug. 17, 1990.

"Two New Systems for Measuring Alignment Thermal Growth"; *Vibrations Magazine;* Murray, Malcolm; Baytown, Texas Dec. 1990.

*Primary Examiner*—Peter Vo

*Attorney, Agent, or Firm*—John Russell Uren

[57] ABSTRACT

An apparatus for mounting a scrubber pressure vessel to a base. The scrubber has a skirt which is mounted directly onto the base. The base has two orthogonal longitudinal beams. The beams are oriented with respect to the pressure vessel such that the forces directed to the scrubber by its attached piping are parallel to one of the beams. The skirt is attached to the base on the longitudinal axes and the connections may vary in stiffness such that the natural frequencies of the system along both axes can be adjusted to avoid the operating frequency which would otherwise result in resonance.

2 Claims, 7 Drawing Sheets

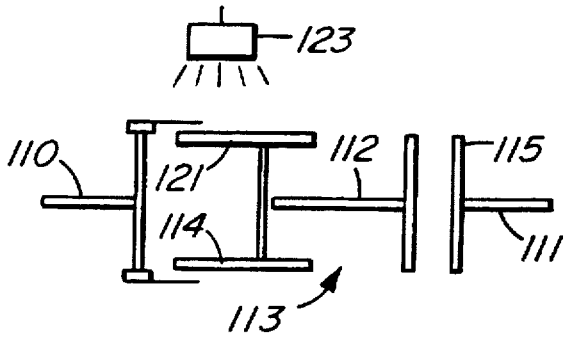
FIG. 5A
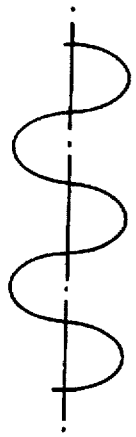
FIG. 5B
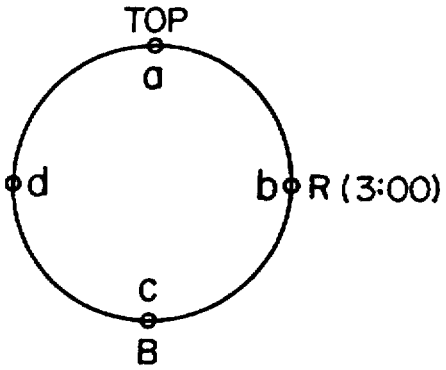
FIG. 5C
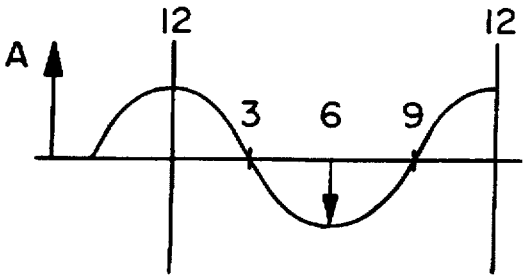
FIG. 5D
| POSITION OF A | VERNIER A | POSITION OF B | VERNIER B | $\frac{A-D}{2}$ |
|---|---|---|---|---|
| 12 | $a_1$ | 6 | $a_2$ | 0 |
| 3 | $b_1$ | 9 | $b_2$ | 0 |
| 6 | $c_1$ | 12 | $c_2$ | 0 |
| 9 | $d_1$ | 3 | $d_2$ | 0 |
FIG. 6

SCRUBBER MOUNTING APPARATUS

This application is a continuation of U.S. patent application Ser. No. 08/253,361, filed Jun. 3, 1994 now abandoned, which is a CIP of Ser. No. 08/004,792 filed on Jan. 14, 1993, now abandoned.

INTRODUCTION

This invention relates to a method and apparatus for mounting a pressure vessel and, more particularly, to a method and apparatus for mounting a scrubber pressure vessel in order to adjust the natural frequency of the system.

BACKGROUND OF THE INVENTION

Pressure vessels are typically circular in cross section and are connected to a circular elongate skirt which may have stiffeners or gussets for strength. The skirt is often mounted to a flat, rectangular base plate by welding and the base plate is then attached to a pedestal which is then attached to a skid or directly to a concrete floor by way of bolts which run through the base plate to the floor at the four corners.

In the case of pressure vessels such as scrubbers, gas within the vessel passes to a compressor through piping where it is compressed for further processing. The pressure vessel is subject to vibration forces which originate within the compressor and which are passed to the pressure vessel by way of piping extending between the scrubber and the bottle connected to the compressor, or by way of the base.

It is important that the operating frequencies of the forces applied to the scrubber be well away from the resonant or natural frequencies of the scrubber system in order to remove any adverse effects that can occur on the scrubber because of the forces created by the operating vibrations which may result in resonance. In the event the natural frequency of the scrubber system is not well outside the window of the operating frequencies, the longevity of the system components is adversely affected and can result in premature failure.

Heretofore, the bolts extending through the base plate would only coincidentally fall on the major and minor axes coinciding with the axis of the piping entering the scrubber from the compressor. The bolts were always located outside the circumference of the skirt between the base plate and the scrubber. Typically, the diagonals formed by the opposing bolt holes would fall at 45° from the axis of the scrubber aligning with the crank shaft of the compressor. Any adjustment of the natural frequency of scrubber by way of removing spacers or replacing spacers with Belleville springs and the like was difficult since such adjustment had an affect on the stiffness along both axes of the pressure vessel. To assist in adjusting stiffness, holes or cutouts would be cut in the skirt. Besides being a difficult task to easily perform for flexibility, such recesses could affect both the axes of stiffness of the pressure vessel. The usability of this hole or cutout technique would often be limited.

A further problem with existing base designs is that different base plates must be used with scrubbers of different diameters. There is little flexibility to utilize a single base design with scrubbers of different diameters.

In coupling shafts, it is important that the axial alignment of the two shafts be as close as possible in order that any vibration is removed or reduced. Shaft misalignment can result in vibration which can affect the life of system components and, eventually, can result in failure.

The alignment of the two shafts is taken by measurements in orthogonal planes, usually the vertical and horizontal planes. Such measurements can be obtained without undue difficulty with the shafts in a static condition. However, under dynamic operating conditions under load, the shafts may no longer be aligned due to various forces which arise during rotation.

U.S. Pat. No. 4,928,401 to Murray teaches a dynamic method of aligning two shafts connected by a coupling. Vernier scale sets are mounted at the twelve o'clock position across the flexible elements of the coupling spanning the shafts and a strobe light is used to observe the scale readings at a plurality of locations, conveniently three or four, around the circumference of the flexible elements while the shafts are rotated and are under load. If there is an angular misalignment between the spool piece of the coupling and the driver or driven shafts, the scale readings will differ, for example, between the twelve o'clock and six o'clock positions. These differences will result in a value for the angular offset of the spool piece relative to the shafts and the shafts can be aligned accordingly.

The technique of the '401 patent, however, is less useful in the event there is also oscillating axial movement of the spool piece of the coupling or the shafts. In the event the two shafts and the coupling are perfectly aligned but there is a relative oscillating axial movement between the spool piece and the shaft, the readings of the single vernier scale taken at the twelve o'clock and six o'clock positions will be different and will contain an increment due to the axial movement. It can give rise to a wrongful assumption that the shafts are incorrectly aligned.

If there is both oscillating relative axial movement between the shaft and the spool piece of the coupling and also an angular misalignment between the shaft and spool piece, the teachings of the '401 patent will result in incorrect measurements. This is so because when, in the example given, the vernier has rotated 180 degrees from the twelve o'clock to the six o'clock position, the scales will read differently thereby indicating what increment of the reading is due to axial movement of the spool or shafts and what increment is due to angular misalignment.

SUMMARY OF THE INVENTION

According to one aspect of the invention, there is provided apparatus for mounting a pressure vessel having a skirt to a base, said apparatus comprising a base having first and second beams, the longitudinal axes of said first and second beams being orthogonal, means to connect each of said beams to a support and means for connecting said skirt to said base on said longitudinal axes of said first and second beams.

According to a further aspect of the invention, there is provided a method for mounting a pressure vessel to a base comprising the steps of mounting a pressure vessel with a skirt to a base having orthogonal beams, each of said beams having a longitudinal axis, connecting said base to a support symmetrically with respect to said longitudinal axes and connecting said skirt to said base symmetrically with respect to said longitudinal axes of said beams.

According to the invention, there is provided a shaft alignment system comprising first and second shafts, a coupling connecting said first and second shafts, said coupling comprising a spool piece and at least one flexible element between said shaft and spool piece, first and second means to measure the distance between said shaft and said spool piece across said flexible element at a radial offset from the center of rotation of said shaft and means to read said distances of said first and second distance measuring means, the values of said first and second distance measuring means each being taken individually while said shaft and spool piece are rotating.

According to a further aspect of the invention, there is provided a method of determining the angular misalignment between a shaft and a spool piece across a flexible element of a coupling connecting said shaft and spool piece comprising the steps of mounting a first distance measuring means across said flexible element at a radial offset from the center of rotation of said shaft and spool piece at a first location, mounting a second distance measuring means across said flexible element of a coupling at a radial offset from the center of rotation of said shaft and spool piece at a second location removed from said first location and reading the values from each of said first and second distance measuring means while said shaft and spool piece are rotating.

BRIEF DESCRIPTION OF THE SEVERAL VIEWS OF THE DRAWINGS

A specific embodiment of the invention will now be described, by way of example only, with the use of drawings in which:

FIGS. 5A through 5D illustrate the measuring technique according to the teachings of U.S. Pat. No. 4,928,401 as compared with the measuring technique according to the present invention;

FIG. 6 is a table giving the values obtained from the techniques of FIG. 5;

DESCRIPTION OF SPECIFIC EMBODIMENT

Figure 1:
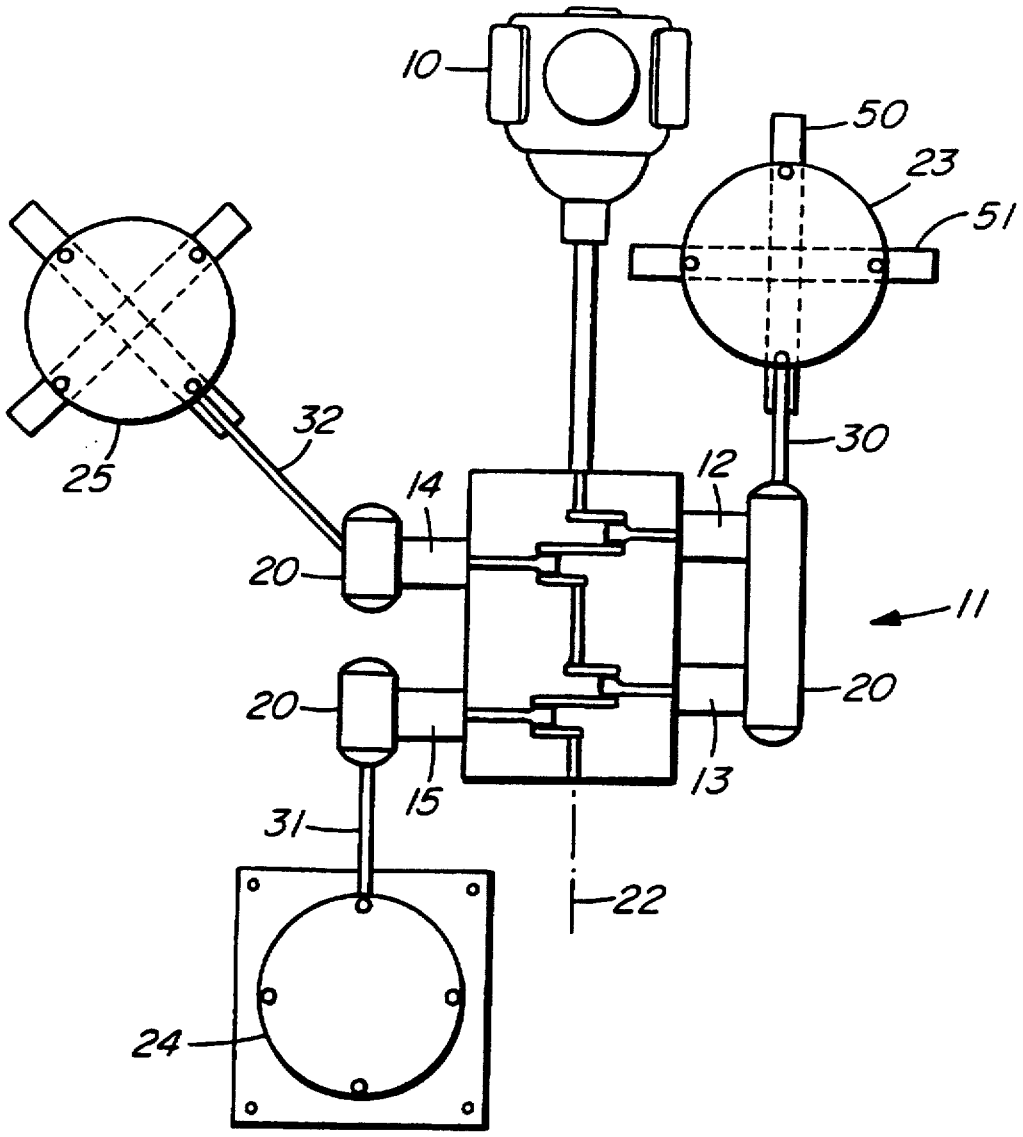
FIG. 1 is a diagrammatic view of a compressor and engine with three scrubber pressure vessels mounted to provide gas to the compressor through bottles located in operable relationship with the cylinders of the compressor.

Reference is now made to the drawings and, in particular, to FIG. 1 where an engine 10 powers a compressor generally illustrated at 11, compressor 11 having four cylinders 12, 13, 14, 15 to which bottles 20 are connected. The crankshaft 21 has an axis 22 about which it rotates and the pistons (not shown) of cylinders 12, 13, 14, 15 move normal to the axis of the crankshaft 21 in the cylinders. This movement of the crankshaft 21 and the pistons creates orthogonal forces, namely horizontal forces and axial forces as indicated in FIG. 1.

Three pressure vessels in the form of scrubbers 23, 24, 25 are connected to gas supplies on the sides indicated and to piping 30, 31, 32, respectively, which runs from the scrubbers 23, 24, 25 to the bottles 20. The bottles 20 are connected to the appropriate cylinders of the compressor 11. Thus, the gas enters the cylinders 12, 13, 14, 15 and is compressed by the pistons of compressor 11.

Figure 2:
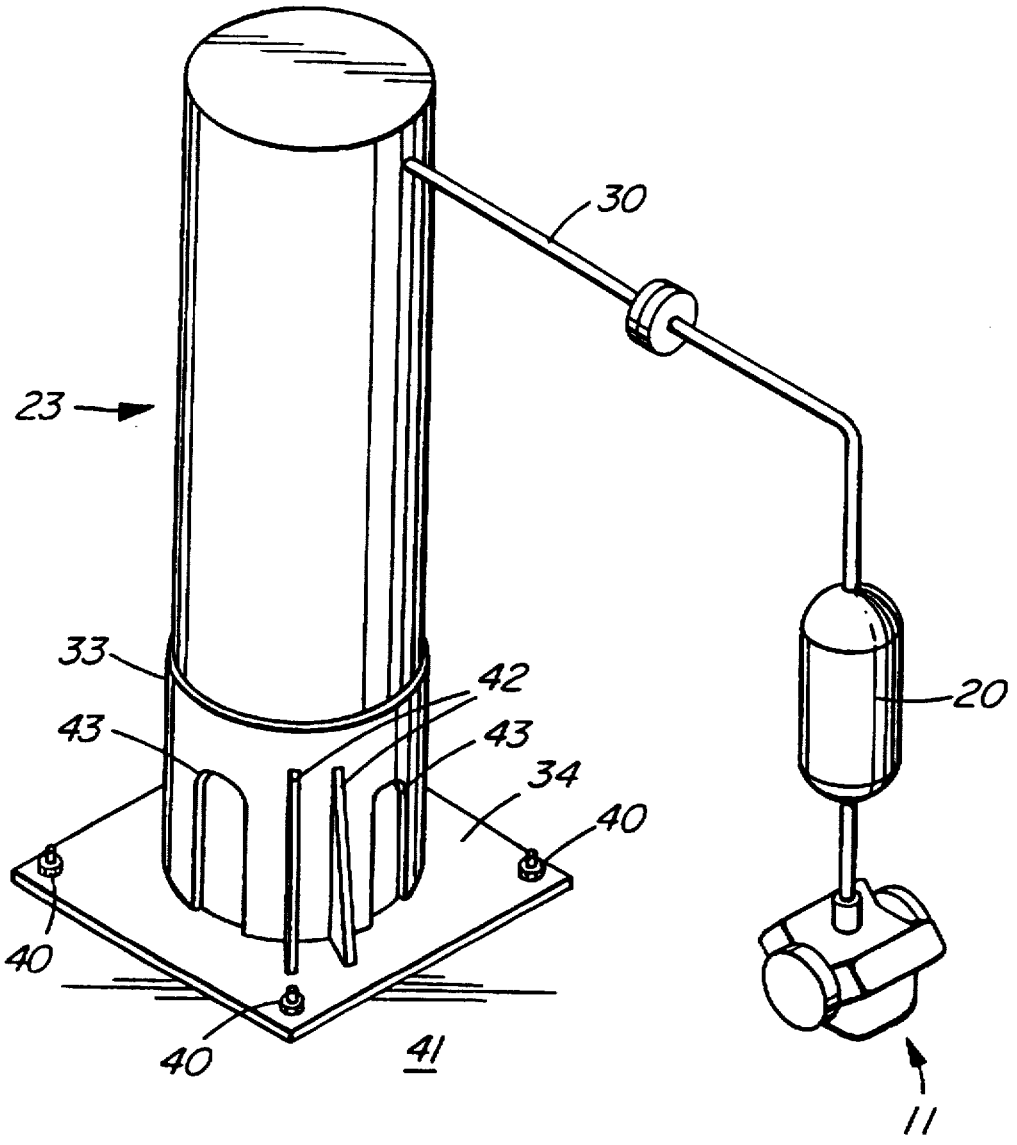
FIG. 2 is a diagrammatic isometric view of a scrubber mounted to a base plate and having a skirt located between the pressure vessel and the base plate according to the prior art.

Reference is now made to FIG. 2 wherein a typical scrubber 23 is illustrated with piping 30 running from the vessel 23 to the bottle 20 and, thence, to the compressor 11. The scrubber 23 is mounted to a circumferential and elongate skirt 33 by welding. The skirt 33 is mounted to a base plate 34 by, for example, welding. Bolts 40 in each of the four corners of the base plate 34 run through the base plate to the base 41 and tightly mount the pressure vessel 23 to the base 41 which can be, for example, a concrete floor, a skid or a pedestal. Stiffeners 42 can be added to the skirt 33 and recesses or cutouts 43 can be cut in the skirt 41 to change the natural frequency of the scrubber 23 and its associated components so as to avoid resonance.

Figure 3:
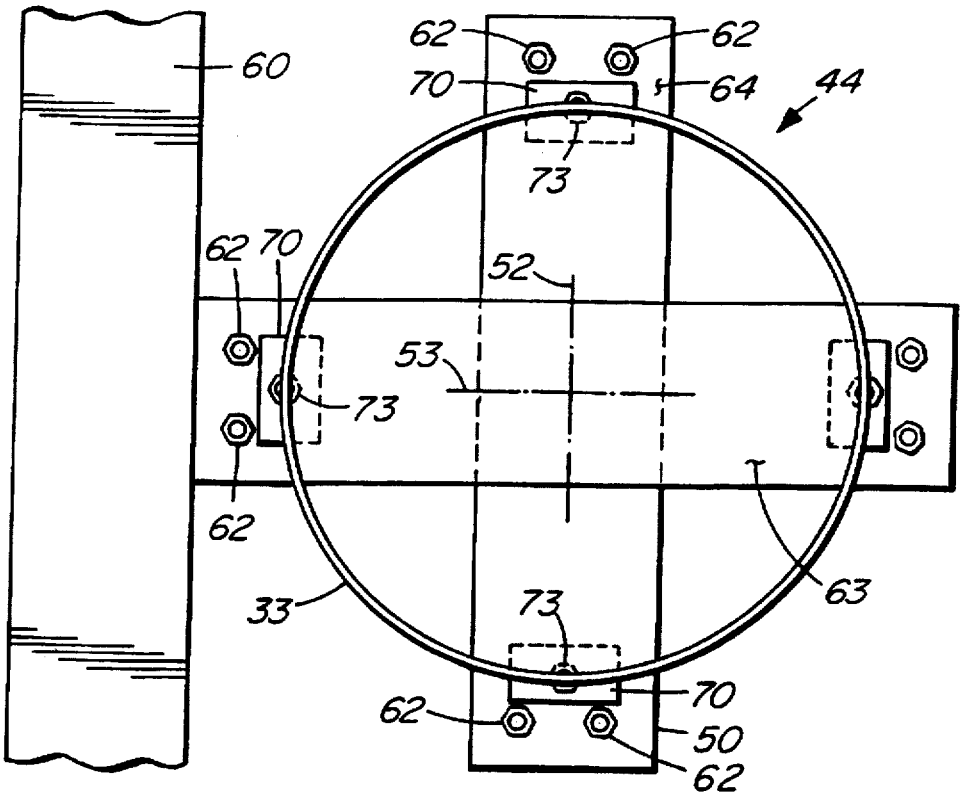
FIG. 3 is a diagrammatic plan view illustrating the base according to the invention which is connected to a support and further illustrating the bottom of the skirt of the scrubber connected to the base.
Figure 4:
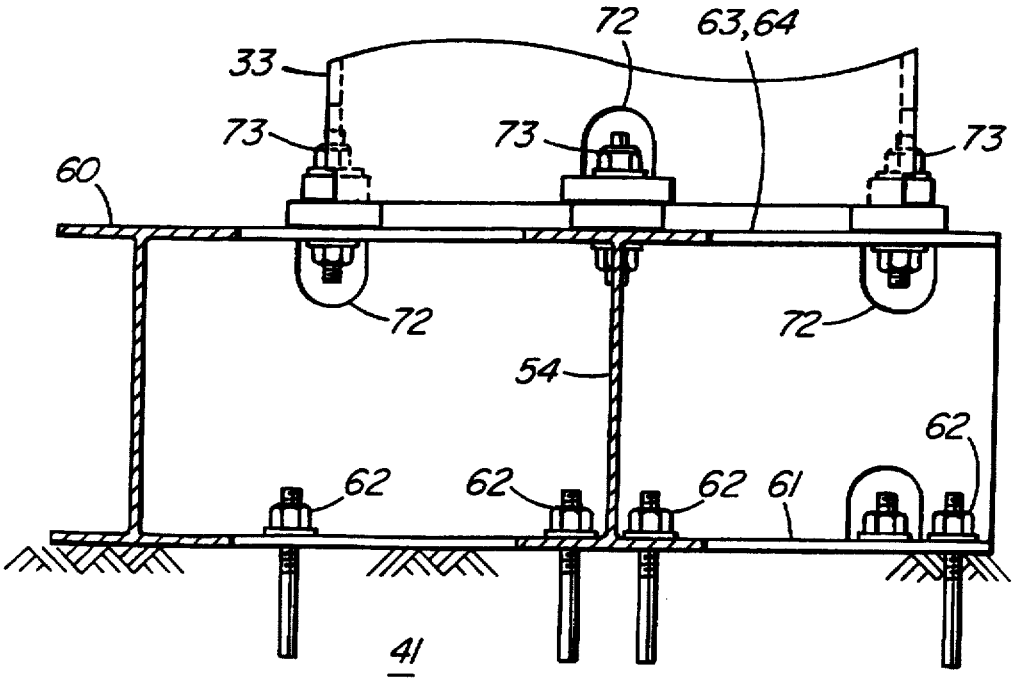
FIG. 4 is a side view of the apparatus of FIG. 3.

A base plate according to the invention is illustrated generally at 44 (FIG. 3). It comprises two wide flange or I-beams 50, 51 joined together and mounted at right angles. Each of the I-beams 50, 51 has a longitudinal axis 52, 53, respectively, running parallel to the webs 54, 55 (FIG. 4) of the respective I-beams 50, 51. Conveniently, the I-beams 50, 51 may be connected to the main skid 60.

The lowermost flange 61 of the I-beam 51 may be connected to the floor by the use of bolted connections 62 which extend through the flange 61 and into the floor or base 41. The bolts 62 are mounted symmetrically with respect to the longitudinal axes 52, 53 of the I-beams 50, 51 as best seen in FIG. 3. The longitudinal axes 52, 53 of the I-beams 50, 51 correspond to the webs 54, 55 of the i-beams 50, 51.

The scrubber skirt 33 is conveniently connected to the uppermost flanges 63, 64 of the I-beams 51, 50 by way of gussets 70 which are welded to the bottom of scrubber skirt 33. Bolted connections 71 extend through each of the gussets 70 and into the upper flanges 63, 64 of the respective I-beams 51, 50. Cutouts 72 in the skirt 33 and in the webs 54, 55 are provided so that the bottom circumference of the skirt 33 is directly mounted to the upper flanges 63, 64 of the I-beams 51, 50 symmetrical with respect to the webs 52, 53.

OPERATION

In operation, the scrubber 23 will be mounted to the skirt 33 as, for example, by welding and the skirt 33 and scrubber 23 will be mounted directly on top of the two I-beams 50, 51 of the base plate 44. The beams 50, 51 are oriented at right angles as shown and one of the beams 50 will run parallel to the piping 30 (FIG. 1) which runs from the pressure vessel 23 to the bottle 20 of the compressor 11. Thus, the two beams 50, 51 of the base 44 will be parallel and perpendicular to the forces which act on the scrubber 23 in the piping.

The I-beams 50, 51 are then connected to the floor or base 41 with the use of bolted connections 62 as has been described.

The bolted connections 73 connecting the skirt 33 of the scrubber 23 to the two I-beams 50, 51 may then be adjusted so that the flexibility of the connection in either axial direction may be varied. For example, springs such as Belleville springs or coiled springs (not illustrated) can be added to the connections 73 on I-beam 51 in order to provide for greater flexibility in the axis 53 of I-beam 51. Likewise, the connections 70 can be tightly secured in the axial direction of I-beam 50 so that flexibility in this direction is reduced. Thus, the natural frequency of the scrubber 23 and its associated components along both axes can be adjusted such that the frequency is sufficiently above and/or below the operating frequency of the system to thereby avoid any resonant conditions. This will reduce the forces acting on the system and thereby preserve component operating life.

It is intended to provide a scrubber base apparatus which provides:

i) Max stiffness in optimum primary directions, parallel and perpendicular to compressor crankshaft; and ii) Means of adjusting the scrubber natural frequencies by adjusting the stiffness along either of the primary axis independently of each other.

Figure 10:
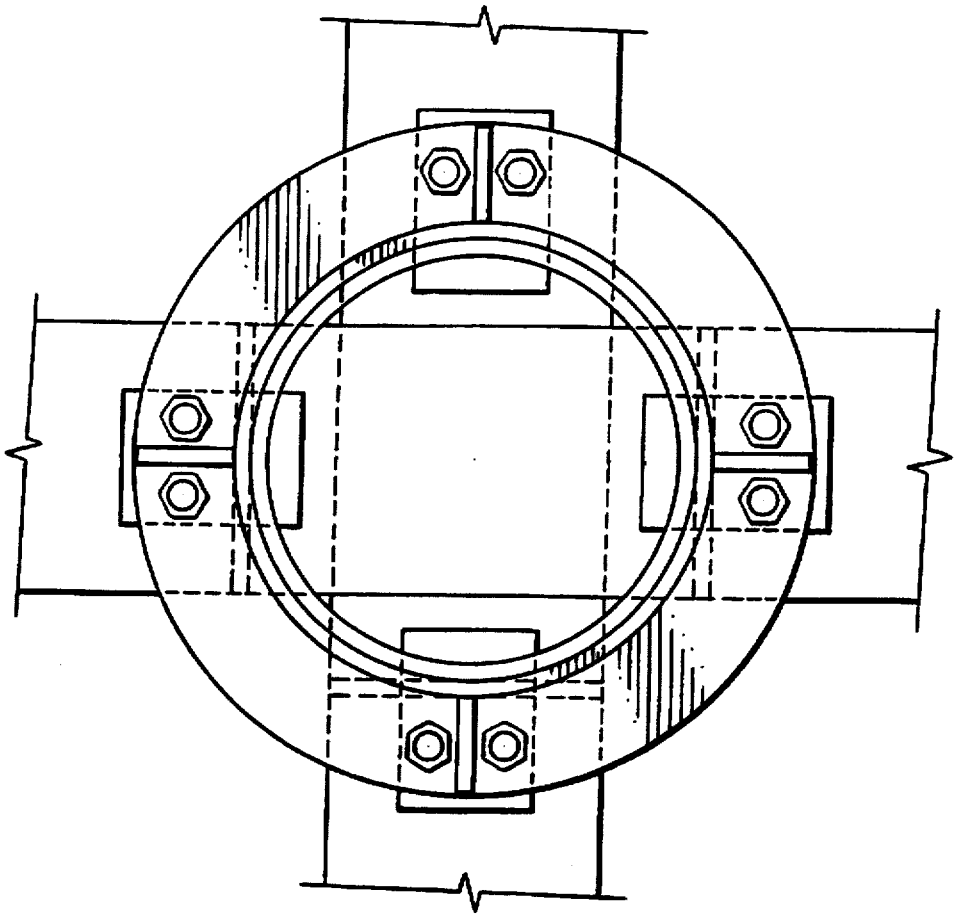
FIGS. 10 through 13 are views of alternate embodiments of the invention used to attach a scrubber to a base similar to those of the embodiment illustrated in FIGS. 3 and 4.
Figure 11:
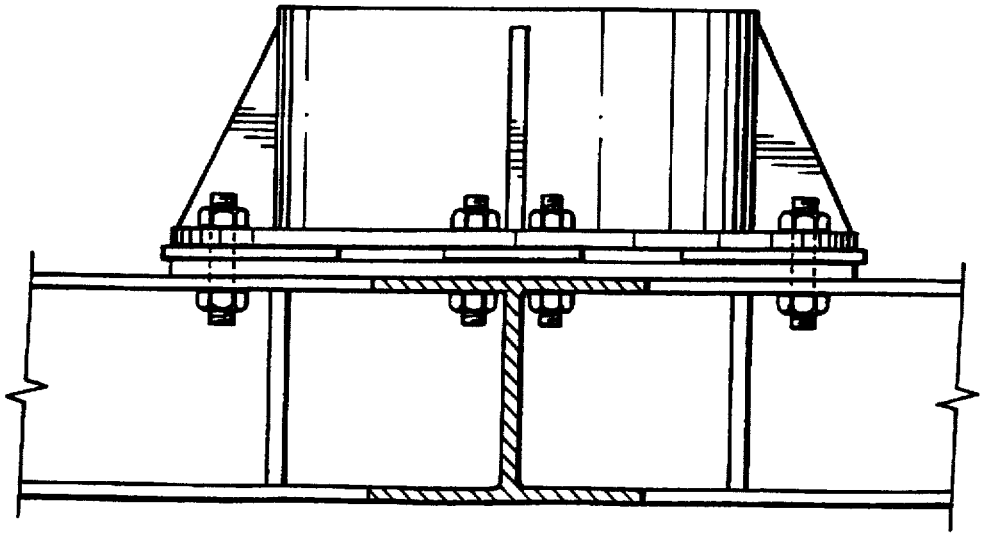
Figure 12:
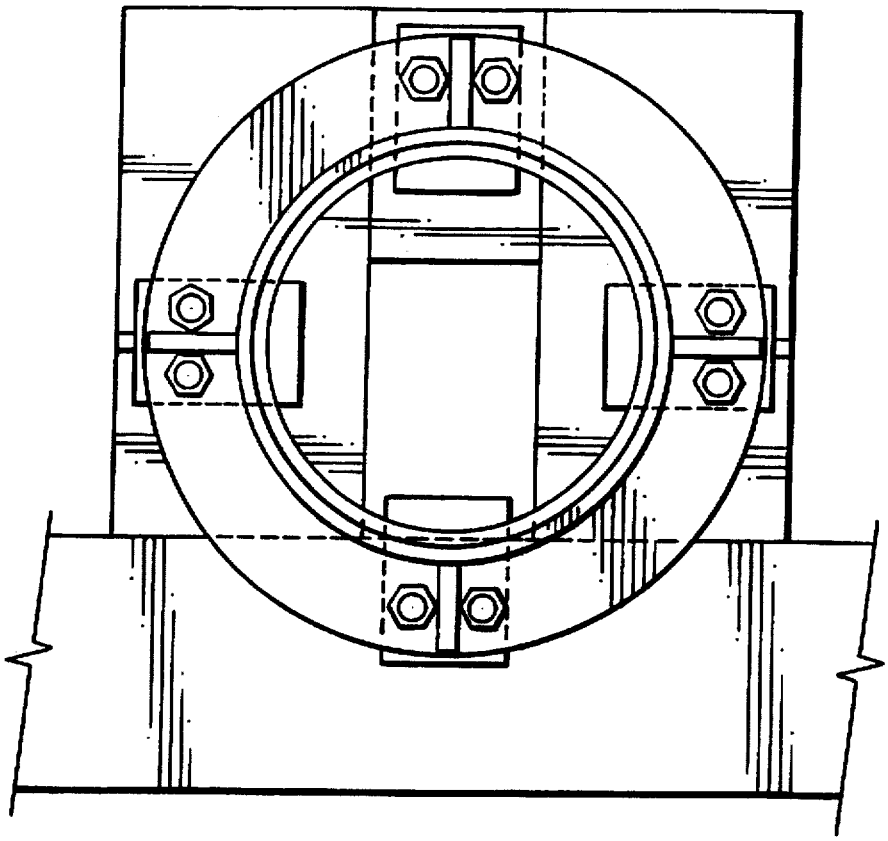
Figure 13:
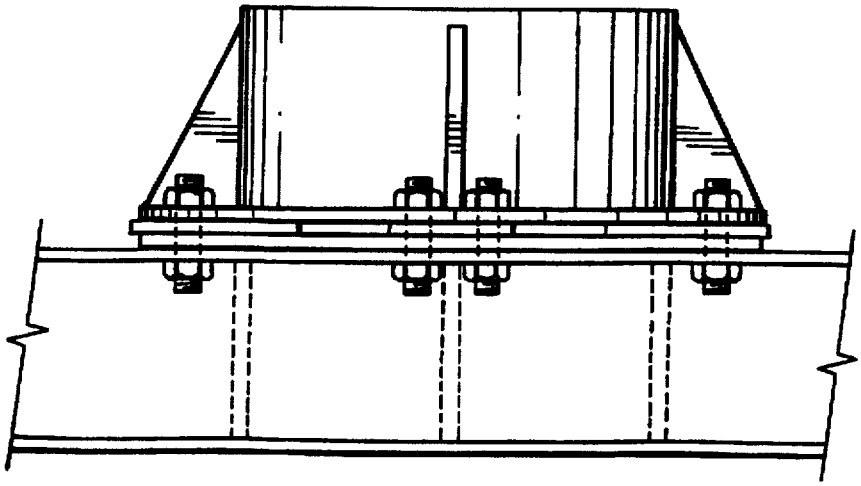

The location of orthogonal skid I-beams running directly below the scrubber skirt with their axis parallel and perpendicular to the compressor crankshaft (see FIGS. 10 and 11) is necessary only to establish the most economical (in terms of quantity of steel required) method to attain maximum stiffness along the axis of the scrubber aligned parallel and perpendicular to the compressor crankshaft. Other substructure configurations such as a box configuration (shown in FIGS. 12 and 13) and solid concrete bases can also be accommodated effectively.

In addition to the methods of adjusting the mechanical natural frequency of the scrubber in the primary directions, i.e. parallel or perpendicular to the compressor crankshaft, independent of one another previously discussed. That is by springs, be they Belleville washers or coil springs, installed between the scrubber skirt plate and the scrubber base structure.

The addition of a circular baseplate gusseted from the scrubber skirt and a matching circular plate welded to the top of the base structure allows complete mechanical natural frequency ("MNF") adjustments along either of the primary directions independently. This is achieved by utilizing the cantilevered circular baseplate as a widely adjustable spring by altering the locations of shim pads between the plate attached to the scrubber and the plate on the support structure. See FIGS. 10–13 and diagrams 1 through 3 below.

DIAGRAM 1

Shim pads at all four scrubber base bolt locations:

Maximum stiffness from base in both primary directions. Highest attainable MNF in both direction.

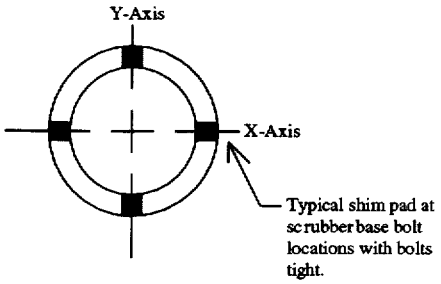

DIAGRAM 2

Shim pads at two locations along x-axis only:

Maximum stiffness along x-axis, minimum stiffness along y-axis. Highest attainable MNF in x-direction. Lowest attainable MNF in y-direction.

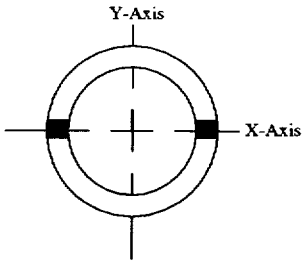

DIAGRAM 3

Shim pads at two locations along x-axis, adjustment shim pads at four other locations.

Maximum stiffness along x-axis, intermediate stiffness along y-axis. Highest attainable MNF in x-directions, intermediate MNF in y-direction.

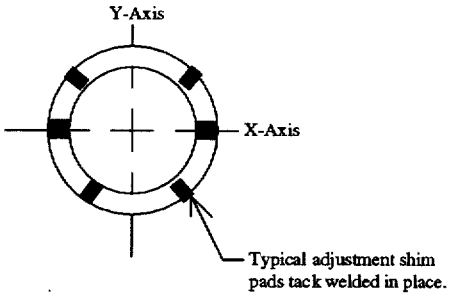

The adjustment of Base stiffness and thusly the MNF's is affected by a combination of the following:

i) Presence/absence of main shim pads.

ii) Tightness of bolts at main shim pad locations.

iii) Number of adjustment shim pads.

iv) Location of adjustment shim pads along circumference and radially from the skirt to the edge of scrubber base plate.

Referring to FIG. 5A, a driver shaft 110 and a driven shaft 111 are connected by a coupling generally illustrated at 113. The coupling 113 includes a spool piece 112 and two flexible elements 114, 115, only one of which is illustrated in detail.

Figure 9:
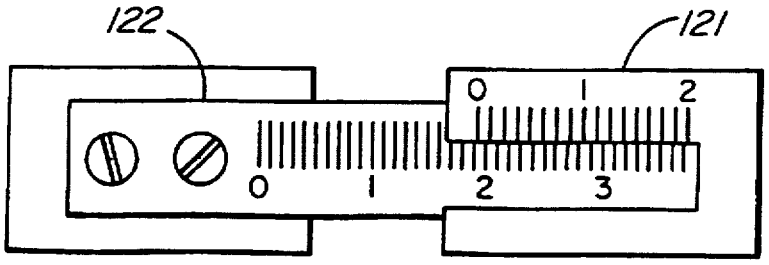
FIG. 9 is a plan view of a typical vernier scale used according to the invention.

In the technique according to U.S. Pat. No. 4,928,401, a single vernier scale 120 is mounted on the top or twelve o'clock position of the flexible element 114 with the base or scale piece 121 (FIG. 9) being mounted on the spool side of the flexible element 114 and the indicator piece 122 being mounted on the driven shaft side of the flexible element 114. The vernier scale 120 is mounted at a radial offset from the center of rotation of the driver and driven shafts 110, 111 and the spool piece 112. A strobe light generally illustrated at 123 is mounted so that the readings between the scale 121 and the indicator arm 122 may be obtained at various positions about the circumference of the flexible element as the single vernier scale 120 on each of the flexible elements 114, 115 rotates.

It will initially be assumed that the shafts 110, 111 and the spool piece 112 are in perfect alignment and that there is no axial movement between the shafts 110, 111 and the spool piece 112. In this event, the readings of the vernier scale 120 will be identical no matter where they are taken about the circumference of the flexible element 114. If, for example, the reading of the vernier scale 120 is taken at the 12 o'clock position and, after rotation through 180 degrees, the reading is again taken at the 6 o'clock position, the readings should and will be precisely the same thereby indicating no misalignment.

Figure 8:
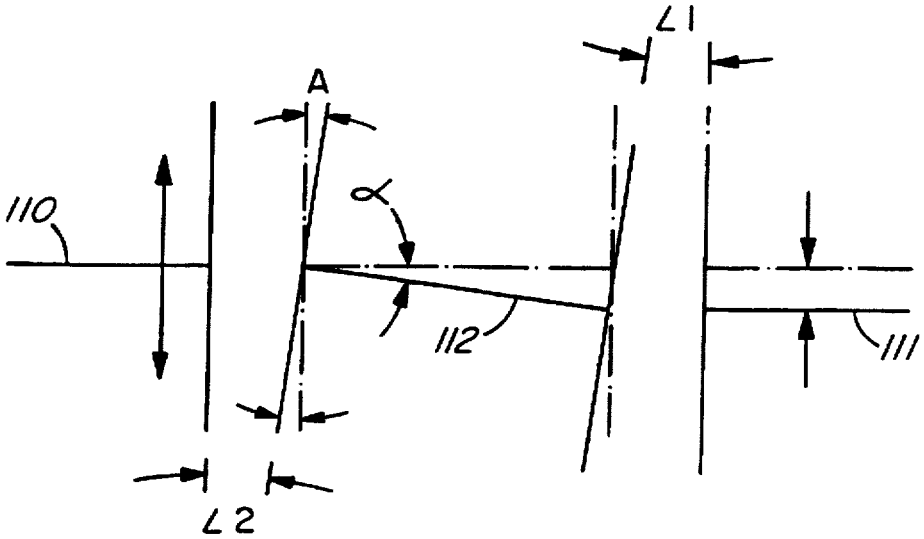
FIG. 8 is a diagrammatic view of the shafts and spool piece illustrating with exaggeration the misalignment of the shafts and spool piece.

If it is now assumed that the shafts 110, 111 and the spool piece 112 are angularly misaligned such as is illustrated in FIG. 8 and that there is no relative axial movement between the shafts 110, 111 and the spool piece 112, the reading of the vernier scale 120 will differ between the 12 o'clock and 6 o'clock positions by a certain amount. For example and with reference to FIGS. 8 and 5C, it will be assumed that the spool piece 112 is angularly offset from the axis of driver shaft 110 by an angle, say alpha. In this event, the vernier scale 120 at the 12 o'clock position will show a reading of, say, +A and the vernier scale 120 at the 6 o'clock position will show a reading of −A. These readings will convert, knowing the diameter of the circle described by the vernier, into a reading from which alpha can be obtained and the angular misalignment calculated.

If, however, the spool piece 112 moves relative to the driver and driven shafts 110, 111 in a sinusoidal relationship as is illustrated in FIGS. 5B and 5D at shaft speed and that there is angular misalignment between the spool piece 112 and the shafts 110, 111, the measurements of the vernier scale 120 will differ at the 12 o'clock and 6 o'clock positions and they will contain an increment due to the angular misalignment and a further increment due to the axial displacement between the shafts 110, 111 and the spool piece 112. The operator may wrongly conclude that there is no axial movement and that the readings are due to angular misalignment only. If both types of movement are present, the readings on the single vernier scale 120 will simply be incorrect.

Figure 7:
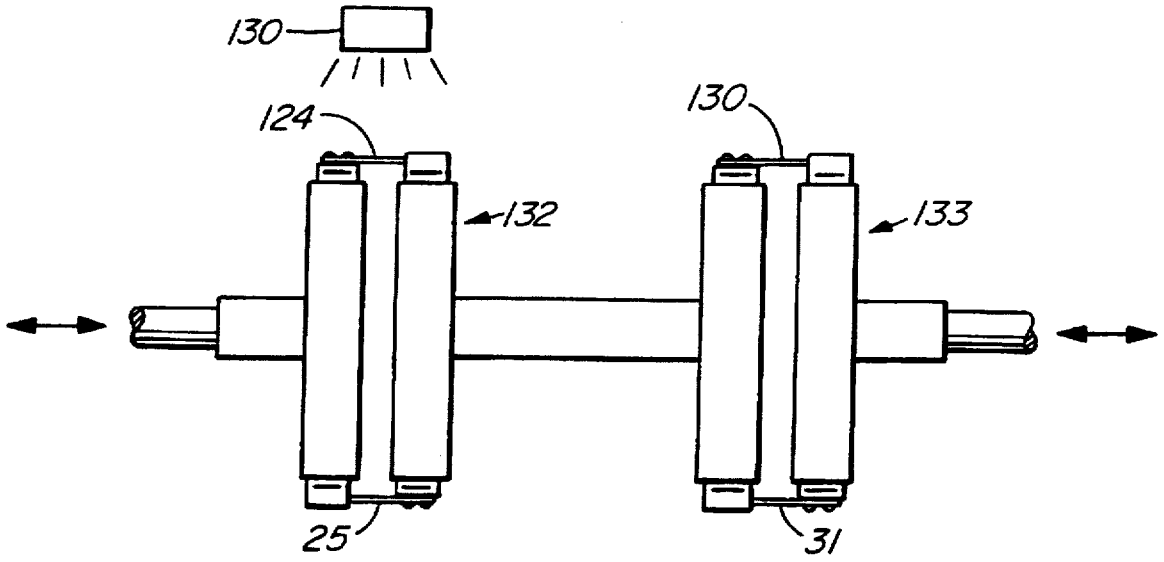
FIG. 7 is a diagrammatic side view of the shafts and spool piece with four(4) vernier scales mounted across the flexible elements of the coupling according to the invention.

Reference is now made to FIG. 7 where vernier scales 124, 125 are located on flexible element 132, 133 and which vernier scales are spaced 180 degrees apart. A strobe light 130 is mounted such that the vernier scales 124, 125 may be illuminated. The reading on the vernier scale 124 at the 12 o'clock position which may contain an axial movement increment will be cancelled out by the axial movement increment contained in the reading on the vernier scale 125 at the six o'clock position. The difference of the two readings which is then divided by two will provide the angular misalignment between the shafts and the spool piece.

It is not necessary to mount the vernier scales 124, 125 exactly 180 degrees apart although such a mounting is convenient for calculation purposes and causes the balance of the system to be unchanged. However, the vernier scales could also be mounted a lesser distance and the values obtained simply be extrapolated to obtain the values that would provide a quantitative result the angular misalignment between the shafts 110, 111 and the spool piece 112.

Many modifications will readily occur to those skilled in the art to which the invention relates and the specific embodiments described should be taken as illustrative of the invention only and not as limiting its scope as defined in accordance with the accompanying claims.

What is claimed is:

1. Mounting apparatus for mounting a pressure vessel having a skirt to a base, said pressure vessel having a longitudinal axis and an entry port having an entry port axis which is perpendicular to said longitudinal axis of said pressure vessel, said pressure vessel having piping entering said pressure vessel at said entry port, said mounting apparatus comprising four(4) anchor points to mount said skirt to said base comprising two I-beams, said anchor points being located on orthogonal axes of said I-beams crossing at a location substantially coaxial with said longitudinal axis of said pressure vessel, two of said anchor points being parallel to said entry port axis of said entry port and two of said anchor points being perpendicular to said entry port axis of said entry port, connectors to connect said skirt to said base at each of said anchor points and shims including spacers and spring removably mounted between said skirt and said base at at least one of said anchor points for adjustably mounting said skirt to said base, each of said I-beams having a longitudinal axis, said I-beams being joined with said longitudinal axes being orthogonal and crossing at a location substantially coaxial with said longitudinal axis of said pressure vessel, said anchor points being located between said skirt and said I-beams, each of said I-beams each having an upper flange, said anchor points being located between said skirt and said upper flange, said orthogonal longitudinal axes of said I-beams being coincident with said webs of said I-beams, said connectors being mounted between said skirt and said upper flanges of said I-beams over said webs of said I-beams and cutouts in said webs of said I-beams to accommodate said connectors.

2. The mounting apparatus as in claim 1 and further comprising a base plate, said skirt being mounted to said base plate and said base plate being mounted to said base, said base plate having first and second beams, the longitudinal axes of said first and second beams being orthogonal, means to connect each of said beams to said base and means for connecting said skirt to said base plate on said longitudinal axes of said first and second beams.

* * * * *